US012370400B2

(12) United States Patent
Chen

(10) Patent No.: US 12,370,400 B2
(45) Date of Patent: Jul. 29, 2025

(54) MULTIFUNCTIONAL TRAINING HANDLE

(71) Applicant: ANHUI CHAMPION INTELLIGENT MANUFACTURING TECHNOLOGY CO., LTD, Hefei (CN)

(72) Inventor: Zhidong Chen, Hefei (CN)

(73) Assignee: ANHUI CHAMPION INTELLIGENT MANUFACTURING TECHNOLOGY CO., LTD, Hefei (CN)

( * ) Notice: Subject to any disclaimer, the term of this patent is extended or adjusted under 35 U.S.C. 154(b) by 7 days.

(21) Appl. No.: 18/291,883

(22) PCT Filed: Nov. 16, 2021

(86) PCT No.: PCT/CN2021/130794
§ 371 (c)(1),
(2) Date: Jan. 24, 2024

(87) PCT Pub. No.: WO2023/024275
PCT Pub. Date: Mar. 2, 2023

(65) Prior Publication Data

US 2025/0082983 A1 Mar. 13, 2025

(30) Foreign Application Priority Data

Aug. 23, 2021 (CN) ..... 202110969372.5

(51) Int. Cl.
*A63B 21/00* (2006.01)
*A63B 21/068* (2006.01)
(Continued)

(52) U.S. Cl.
CPC ..... *A63B 21/4035* (2015.10); *A63B 21/068* (2013.01); *A63B 21/1636* (2013.01);
(Continued)

(58) Field of Classification Search
CPC ..... A63B 21/4035; A63B 21/068; A63B 21/1636; A63B 23/1218; A63B 23/0205;
(Continued)

(56) References Cited

U.S. PATENT DOCUMENTS 3,716,232 A * 2/1973 Johnson ..... A63B 1/005 482/40
5,776,033 A * 7/1998 Brown ..... A63B 21/1636 482/40
(Continued)

FOREIGN PATENT DOCUMENTS

CN 207119078 U 3/2018
CN 210355871 U 4/2020
(Continued)

OTHER PUBLICATIONS

International Search Report dated Apr. 8, 2022 for International Application No. PCT/CN2021/130794.

*Primary Examiner* — Andrew S Lo

(57) ABSTRACT

The present invention relates to a multifunctional training handle, comprising: a first ring assembly, a second ring assembly, four hanging claw assemblies and a handle assembly; wherein the hanging claw assemblies each comprise a claw arm and a claw part that is fixed to a top end of the claw arm; the first ring assembly and the second ring assembly are assembled, and the second ring assembly has a degree of freedom of coaxial rotation relative to the first ring assembly; and the handle assembly is mounted with the first ring assembly and/or the second ring assembly. The handle, is firmly fixed, convenient to disassemble and assemble, saves space, has a small volume and is convenient to carry; a distance between hanging claws may be rapidly adjusted so as to adapt to door frames of different thicknesses; the handle has abundant functions and high practicability.

10 Claims, 15 Drawing Sheets

(51) Int. Cl.
*A63B 21/16* (2006.01)
*A63B 23/02* (2006.01)
*A63B 23/12* (2006.01)

(52) U.S. Cl.
CPC ..... *A63B 23/1218* (2013.01); *A63B 23/0205* (2013.01); *A63B 2210/50* (2013.01)

(58) Field of Classification Search
CPC ..... A63B 2210/50; A63B 22/20; A63B 23/02; A63B 23/1209
See application file for complete search history.

(56) References Cited

U.S. PATENT DOCUMENTS 9,868,006 B1* 1/2018 Epler ..... A63B 21/068
2009/0203508 A1* 8/2009 Hauser ..... A63B 21/4049 482/139
2010/0144502 A1* 6/2010 Hinds ..... A63B 21/4035 482/141
2012/0225760 A1 9/2012 Webb
2012/0302410 A1* 11/2012 Kitchens ..... A63B 23/1236 482/96
2016/0303419 A1* 10/2016 Karpachevskyy ..... A63B 21/4035
2018/0099199 A1* 4/2018 Rita ..... A63B 69/22
2019/0314671 A1* 10/2019 Abbott ..... F16B 2/12
2019/0344145 A1* 11/2019 Rita ..... F16M 13/02
2021/0106865 A1 4/2021 Reilly
2021/0260439 A1* 8/2021 Abbott ..... A63B 21/1636

FOREIGN PATENT DOCUMENTS

CN 211659144 U 10/2020
CN 211752119 U 10/2020

* cited by examiner

MULTIFUNCTIONAL TRAINING HANDLE

TECHNICAL FIELD

The present invention relates to the field of sports equipment, and in particular, to a multifunctional training handle.

BACKGROUND

With the continuous development of society and continuous improvement of the living standard of people, health has become a primary goal of people. Proper physical exercise has also become an effective means for people to improve their health. In the physical exercise, the sports equipment is used for assisting exercise, so that the efficiency of the exercise can be improved, and the scientificity and the safety of the exercise can be increased.

A pull-up is widely used as a core action of back strength training; however, the pull-up is completed by requiring the support of corresponding equipment such as a horizontal bar. The sports equipment such as a horizontal bar occupies a larger space and needs to be firmly fixed to avoid the risk of overturning. With the continuous development and progress of the concept of household sports equipment, horizontal bar equipment that can be fixed between narrow-distance walls and between door frames is gradually developed, and although the equipment is very suitable for household use, the equipment is mainly supported between two walls or between two vertical surfaces of a door frame and is firmly locked after being supported, which ensures that a user will not fall off when performing pull-up action; in addition, the sports equipment such as a horizontal bar have a single function and is inconvenient to carry.

SUMMARY

In order to solve the technical problems, the present invention provides a multifunctional training handle. The handle can be hung on a door frame for use by using a structure of two pairs of four hanging claws, and is firmly fixed, convenient to disassemble and assemble, saves space, has a small volume and is convenient to carry; in addition, by means of two ring structures that can rotate relative to one another, a distance between the hanging claws may be rapidly adjusted so as to adapt to door frames of different thicknesses; and after simple deformation, the handle can serve as push-up equipment and an abdominal wheel for use, so that the functions are abundant.

The technical solutions used by the present invention to solve the technical problems are as follows:

A multifunctional training handle, comprising: a first ring assembly, a second ring assembly, four hanging claw assemblies and a handle assembly; wherein the hanging claw assemblies each comprise a claw arm and a claw part that is fixed to a top end of the claw arm, and claw parts of the four hanging claw assemblies are configured to be hung in pairs on top edges of two sides of a door frame in a thickness direction;

one of the two hanging claw assemblies fixed on one side of the door frame in the thickness direction and one of the two hanging claw assemblies fixed on the other side of the door frame in the thickness direction form a group and are mounted on the first ring assembly through connecting parts respectively; the other two hanging claw assemblies form another group and are mounted on the second ring assembly through connecting parts respectively;

the first ring assembly and the second ring assembly are assembled, and the second ring assembly has a degree of freedom of coaxial rotation relative to the first ring assembly; and the handle assembly is mounted with the first ring assembly and/or the second ring assembly.

Further, a bottom end of the claw arm is connected to the connecting part through a hinge structure.

Further, the hinge structure comprises a first hinge part arranged at the bottom end of the claw arm, a second hinge part arranged on the connecting part and a pin rod; the pin rod passes through the first hinge part and the second hinge part; and a wheel is further sleeved on the pin rod.

Further, the first ring assembly comprises a first ring loop, and a first inner ring is fixed on an inner wall of the first ring loop; the second ring assembly comprises a second ring loop; the training handle further comprises a third ring assembly; the third ring assembly comprises a third ring loop, and a second inner ring is fixed on an inner wall of the third ring loop; the third ring loop and the first ring loop are mounted and fixed, an outer side surface of the second ring loop is in clearance fit with the inner wall of the first ring loop, a top surface of the second ring loop cooperates with a bottom surface of the first inner ring, and a bottom surface of the second ring loop cooperates with a top surface of the second inner ring; the four connecting parts are separately and correspondingly fixed on an outer periphery of the first ring loop and an outer periphery of the second ring loop; and a space for the connecting part fixed by the second ring loop to pass through and move is reserved between the first ring loop and the third ring loop.

Further, the handle assembly comprises a fourth ring loop and a handle fixed on a bottom side of the fourth ring loop; a first outer convex ring is arranged on a top side of the fourth ring loop; the training handle further comprises a fourth ring assembly, the fourth ring assembly comprises a fifth ring loop; a second outer convex ring is arranged at a bottom side of the fifth ring loop; an outer side surface of the fifth ring loop is in clearance fit with the inner wall of the third ring loop, a top surface of the fifth ring loop cooperates with a bottom surface of the second inner ring, and a top surface of the second outer convex ring cooperates with a bottom surface of the third ring loop; the fourth ring loop passes through inner sides of the first inner ring, the second ring loop, the second inner ring and the fourth ring loop, and a bottom surface of the first outer convex ring cooperates with a top surface of the first inner ring; and the fifth ring loop is fixedly connected to the fourth ring loop.

Further, the handle is in a shape of a hollow circular tube.

Further, a lock assembly is further arranged between the first ring assembly and the second ring assembly, and the lock assembly is configured to enable the first ring assembly and the second ring assembly to be in a locking state or an unlocking state.

Further, a first tooth part is arranged on the outer periphery of the second ring loop; the connecting part of the first ring loop is provided with a slide rail that is opened towards an inner side; the lock assembly comprises a lock block slidably arranged in the slide rail and a shifting mechanism configured to control the lock block to move along the slide rail; and an end part of the lock block is also provided with a second tooth part, so that the second tooth part is engaged with or separated from the first tooth part when the lock block moves along the slide rail under the control of the shifting mechanism, and further the first ring loop and the second ring loop are in a locking state or an unlocking state.

Further, a shifting groove is arranged in the lock block; the shifting mechanism comprises a rotating shaft and a reducing shifting block fixed to the rotating shaft, the reducing shifting block is arranged in the shifting groove, and the reducing shifting block has a small-diameter end and a large-diameter end; the rotating shaft is configured to drive the reducing shifting block to enable a position in contact with the shifting groove to be switched from the small-diameter end to the large-diameter end, and then the lock block is shifted to move towards the first tooth part along the slide rail; a reset assembly is further arranged between one end that is of the lock block and that is far away from the second tooth part and one end that is of the slide rail and that is far away from the inner side opening; the reset assembly is configured to pull the lock block to move away from the first tooth part along the slide rail when the reducing shifting block is switched from the large-diameter end to the small-diameter end.

Further, the lock assembly further comprises a shifting handle; a cover is further arranged on an outer periphery of the third ring loop and fixedly mounted at a bottom end of the connecting part fixed to the first ring loop; and the rotating shaft of the shifting mechanism passes through the cover downwards and then is fixedly connected to the shifting handle.

The present invention has the advantages that: a structure of two pairs of four hanging claws is used, so that the handle may be hung on a door frame for use; the handle is firmly fixed, convenient to disassemble and assemble, saves space, has a small volume and is convenient to carry; by means of the two ring structures that can rotate relative to one another, a distance between hanging claws may be rapidly adjusted so as to adapt to door frames of different thicknesses; after simple deformation, the handle can serve as push-up equipment and abdominal wheel for use; the design of the hollow circular tube of handle allows the entire training handle to be used as a hanger for other equipment; therefore, the handle has abundant functions and high practicability.

DETAILED DESCRIPTION OF EMBODIMENTS

In order to facilitate an understanding of the present invention, the present invention will be further described in detail with reference to accompanying drawings and an embodiment. This embodiment is merely an explanation of the present invention and is not intended to limit the protection scope of the present invention.

Embodiment

Figure 16:
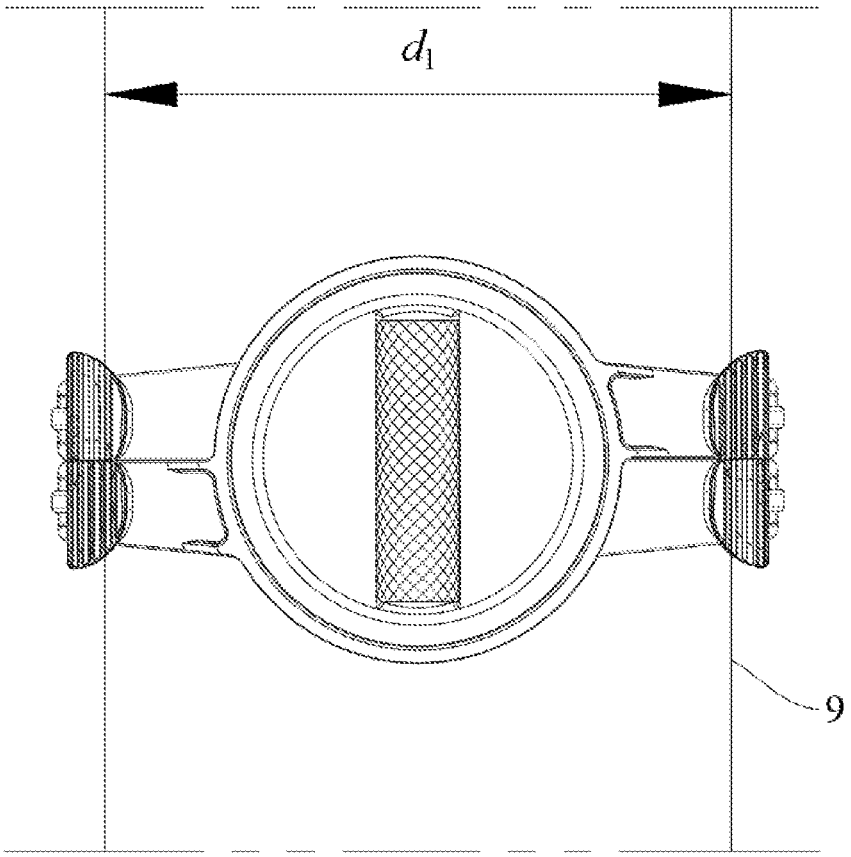
FIG. 16 is a schematic top view of a state in which two hanging claw assemblies on the same side of a multifunctional training handle according to an embodiment are close to each other.
Figure 17:
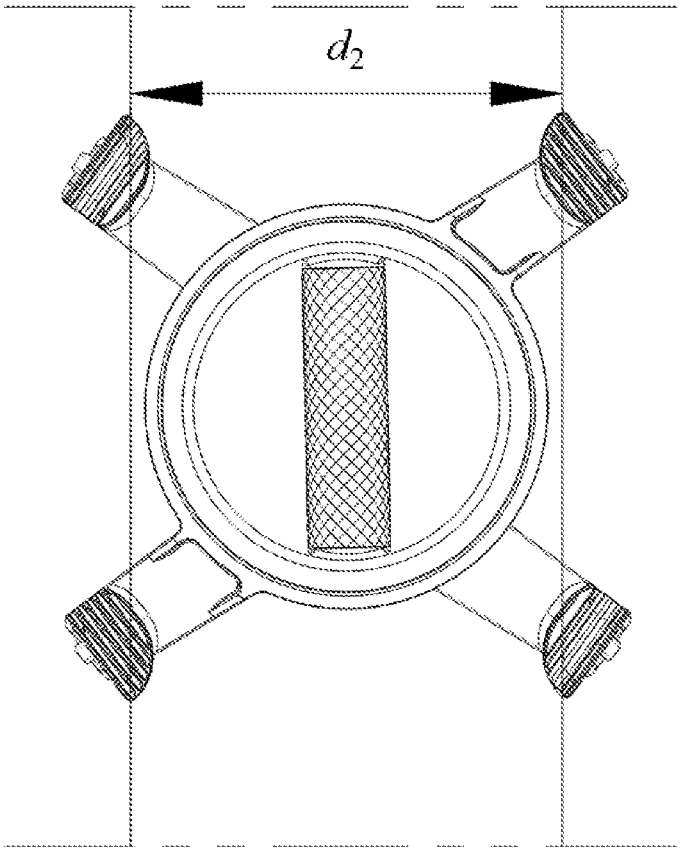
FIG. 17 is a schematic top view of a state in which two hanging claw assemblies on the same side of a multifunctional training handle according to an embodiment are far away from each other.

Referring to FIGS. 1 to 22, this embodiment provides a multifunctional training handle, which comprises a first ring assembly 1, a second ring assembly 2, four hanging claw assemblies 3 and a handle assembly 5; wherein the hanging claw assemblies 3 each comprise a claw arm 31 and a claw parts 34 fixed at a top end of the claw arm 31, and the claw parts 34 of the four hanging claw assemblies 3 are configured to be hung in pairs on top edges of two sides of a door frame 9 in a thickness direction; one of the two hanging claw assemblies 3 fixed on one side of the door frame in the thickness direction and one of the two hanging claw assemblies 3 fixed on the other side of the door frame in the thickness direction form a group and are mounted on the first ring assembly 1 through connecting parts 4 respectively; the other two hanging claw assemblies 3 form another group and are mounted on the second ring assembly 2 through connecting parts 4 respectively; the first ring assembly 1 and the second ring assembly 2 are assembled, and the second ring assembly 2 has a degree of freedom of coaxial rotation relative to the first ring assembly 1, so that the second ring assembly 2 drives a group of hanging claw assemblies 3 thereon to move along a circumferential direction, the two hanging claw assemblies 3 positioned at one side of the door frame in the thickness direction are close to or far away from the two hanging claw assemblies 3 positioned at the other side of the door frame in the thickness direction, so as to further adapt to door frames of different thicknesses (as shown by comparing FIGS. 16 and 17, and as shown by comparing FIGS. 1 and 18, wherein $d_1$ and $d_2$ are thicknesses of the door frames to which can be adapted); and the handle assembly 5 is mounted with the first ring assembly 1 and/or the second ring assembly 2 for providing a gripping location for a user. The handle assembly 5 also has a degree of freedom of coaxial rotation relative to the first ring assembly 1.

Figure 3:
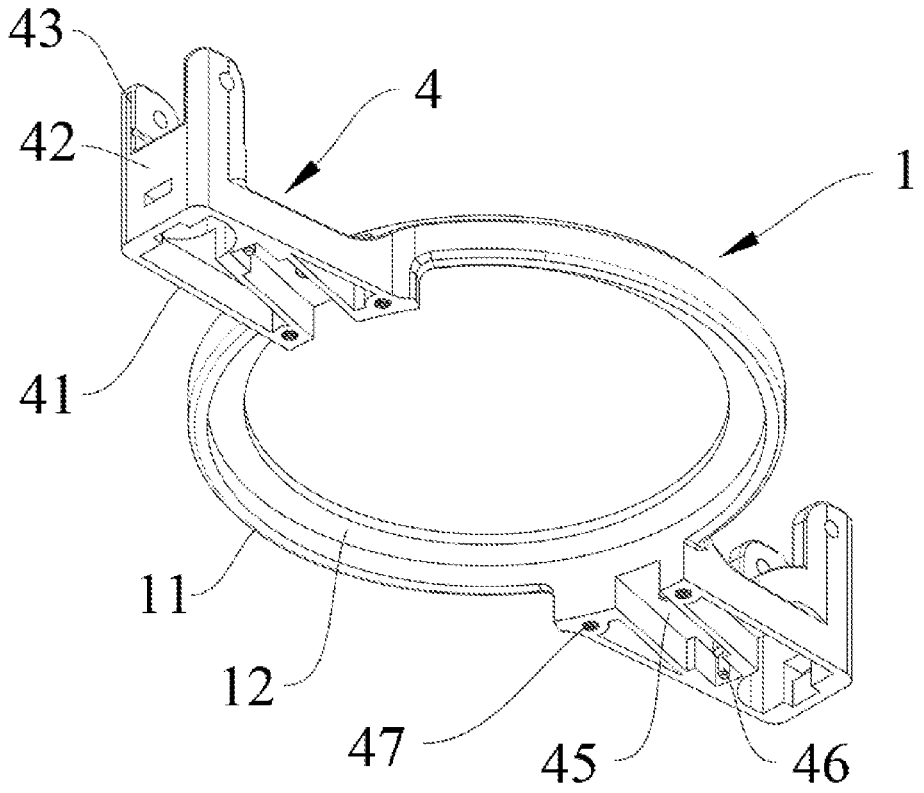
FIG. 3 is a schematic three-dimensional diagram of a first ring assembly of a multifunctional training handle according to an embodiment.

Further referring to FIG. 3, the connecting part 4 is substantially L-shaped, and has a horizontal part 41 and a vertical part 42 fixed to one end of the horizontal part 41, the other end of the horizontal part 41 is fixedly connected to the first ring assembly 1, and a top end of the vertical part 42 is connected to a bottom end of the claw arm 31.

Figure 6:
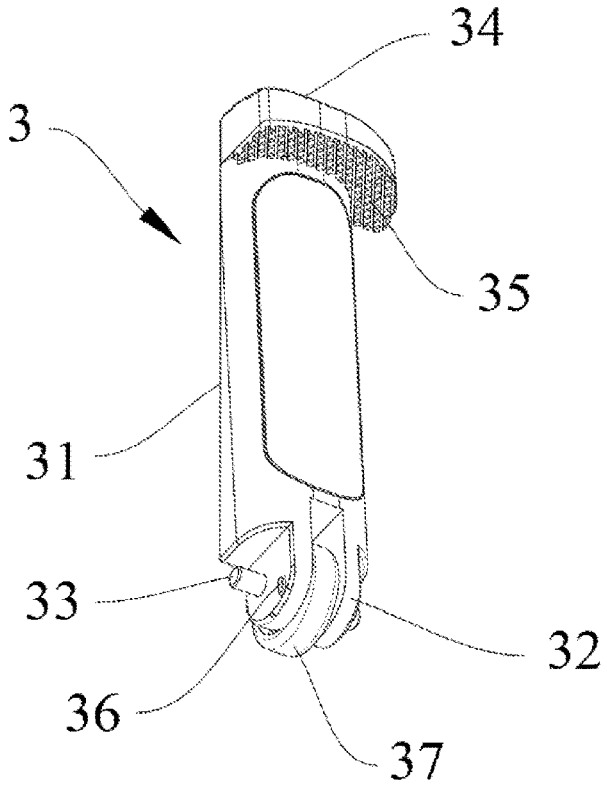
FIG. 6 is a schematic three-dimensional diagram of a hanging claw assembly of a multifunctional training handle according to an embodiment.

Further referring to FIG. 6, an anti-slip pad 35 is also provided on a surface that is of the claw part 34 and that cooperates with the door frame 9.

According to the multifunctional training handle of this embodiment, the bottom end of the claw arm 31 is connected to the connecting part 4 through a hinge structure. When the four hanging claw assemblies 3 are folded to the inner sides of the first ring assembly 1 and the second ring assembly 2 through the hinge structures and are in a horizontal state, a top end of the training handle can be placed downwards, and then the training handle can be used as push-up equipment.

Figure 1:
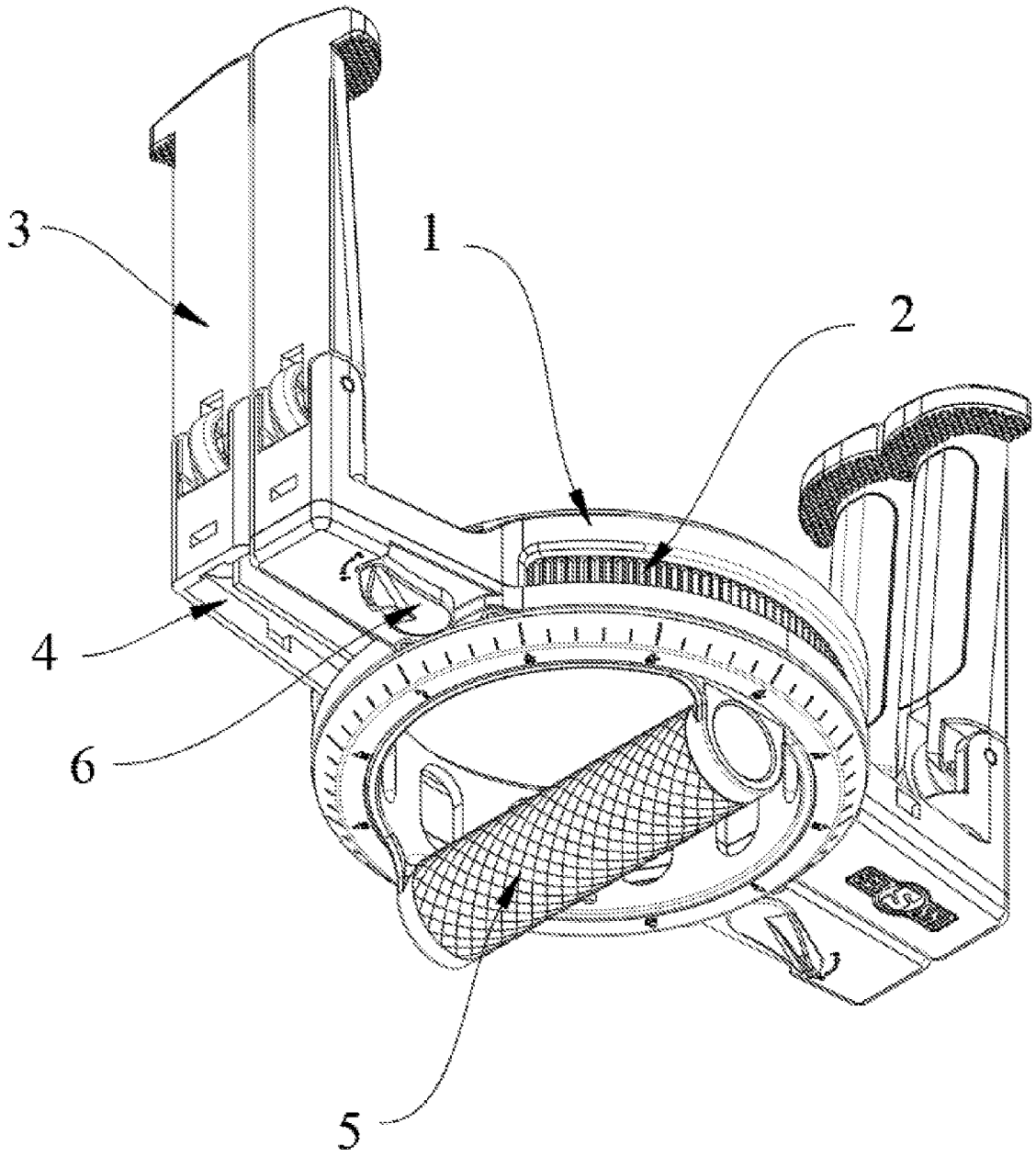
FIG. 1 is a schematic three-dimensional diagram of a multifunctional training handle according to an embodiment.
Figure 19:
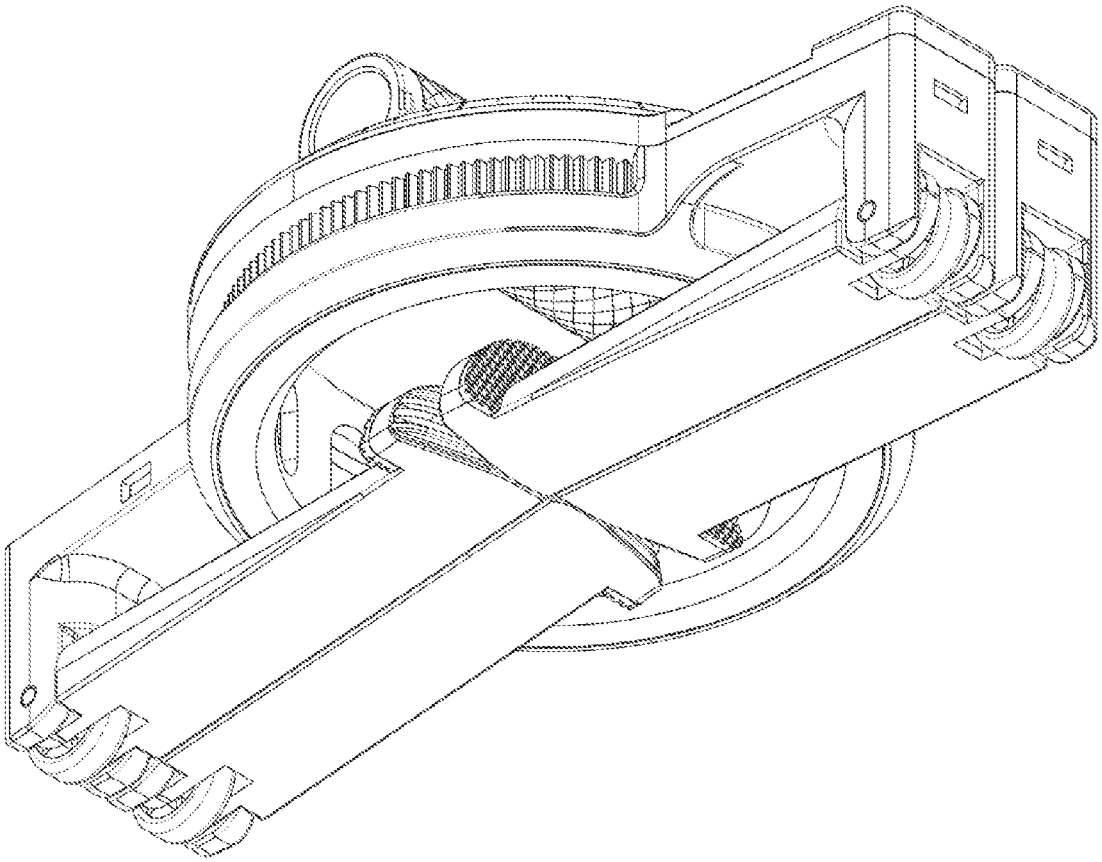
FIG. 19 is a schematic three-dimensional diagram of a state in which a multifunctional training handle according to an embodiment is used as an abdominal wheel.
Figure 20:
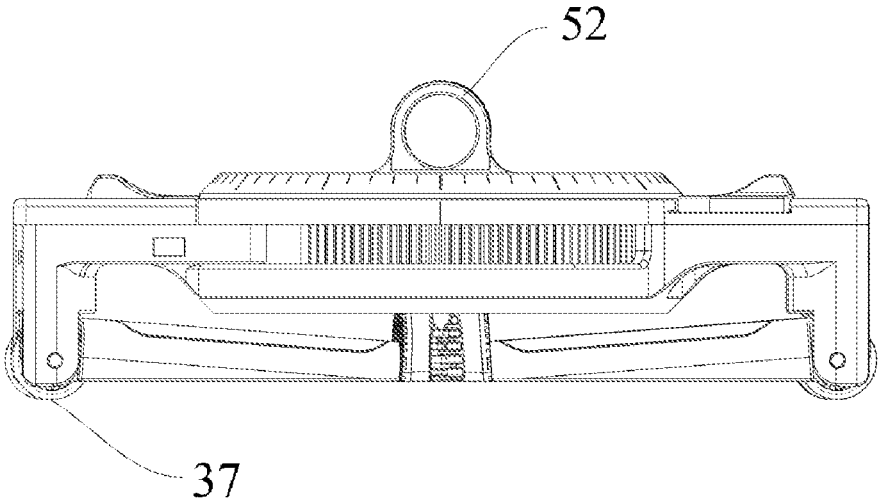
FIG. 20 is a schematic front view of a state in which a multifunctional training handle according to an embodiment is used as an abdominal wheel.
Figure 21:
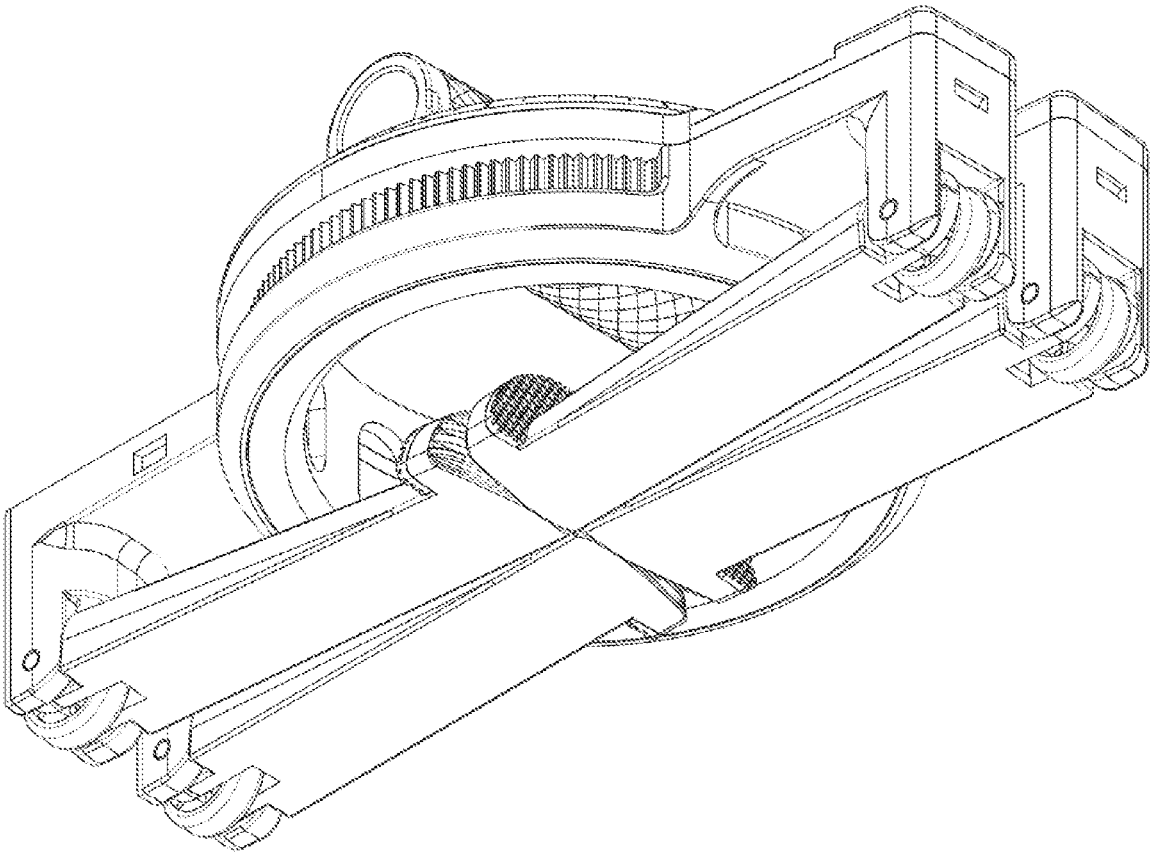
FIG. 21 is a schematic three-dimensional diagram of a state in which a multifunctional training handle according to an embodiment is used as push-up equipment.
Figure 22:
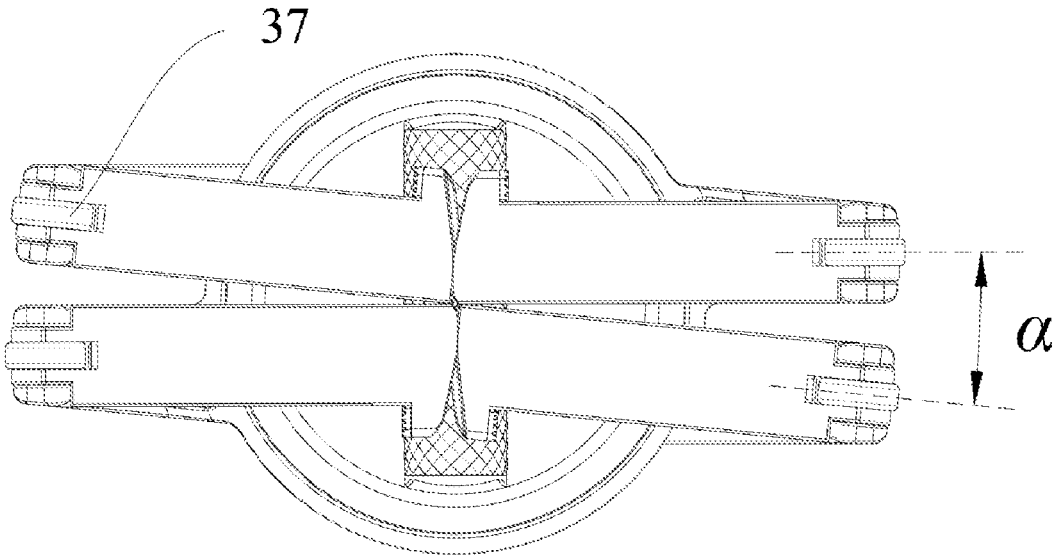
FIG. 22 is a schematic bottom view of a state in which a multifunctional training handle according to an embodiment is used as push-up equipment; and Reference numerals: 1: first ring assembly, 2: second ring assembly, 3: hanging claw assembly, 4: connecting part, 5: handle assembly, 6: lock assembly, 7: third ring assembly, 8: fourth ring assembly, 9: door frame, 11: first ring loop, 12: first inner ring, 21: second ring loop, 22: first tooth part, 31: claw arm, 32: first hinge part, 33: pin rod, 34: claw part, 35: anti-slip pad, 36: convex block, 37: wheel, 41: horizontal part, 42: vertical part, 43: second hinge part, 44: groove, 45: slide rail, 46: second fixed rod, 47: first fixing hole, 51: fourth ring loop, 52: handle, 53: first outer convex ring, 54: third fixing hole, 55: anti-slip sleeve, 61: lock block, 62: second tooth part, 63: shifting groove, 64: shifting mechanism, 65: shifting handle, 66: first fixed rod, 67: reset assembly, 71: third ring loop, 72: second inner ring, 73: cover, 74: handle groove, 75: second fixing hole, 81: fifth ring loop, 82: second outer convex ring, 83: scale, and 84: fourth fixing hole.

Specifically, referring to FIGS. 1, 3 and 6, the hinge structure comprises a first hinge part 32 arranged at the bottom end of the claw arm 31, a second hinge part 43 arranged on the connecting part 4 and a pin rod 33; the pin rod 33 passes through the first hinge part 32 and the second hinge part 43; and a wheel 37 is further sleeved on the pin rod 33. At least a part of the wheel surface of the wheel 37 is exposed outside the hanging claw assembly 3, so that the wheel 37 contacts the ground (or other support surfaces) when the training handle is used as the push-up equipment; in this state, when the wheels 37 of the four hanging claw assemblies 3 are in the same walking direction (as shown in FIGS. 19 and 20), the training handle can be used as an abdominal wheel, and when the wheels of the four hanging claw assemblies 3 are not in the same walking direction, that is, an included angle $\alpha$ is formed between the walking directions of the wheels 37 of the hanging claw assemblies 3 on the same side (as shown in FIGS. 21 and 22), the training handle can be used as push-up equipment, and the direction of the wheels is adjusted by the relative rotation between the first ring assembly 1 and the second ring assembly 2.

Figure 4:
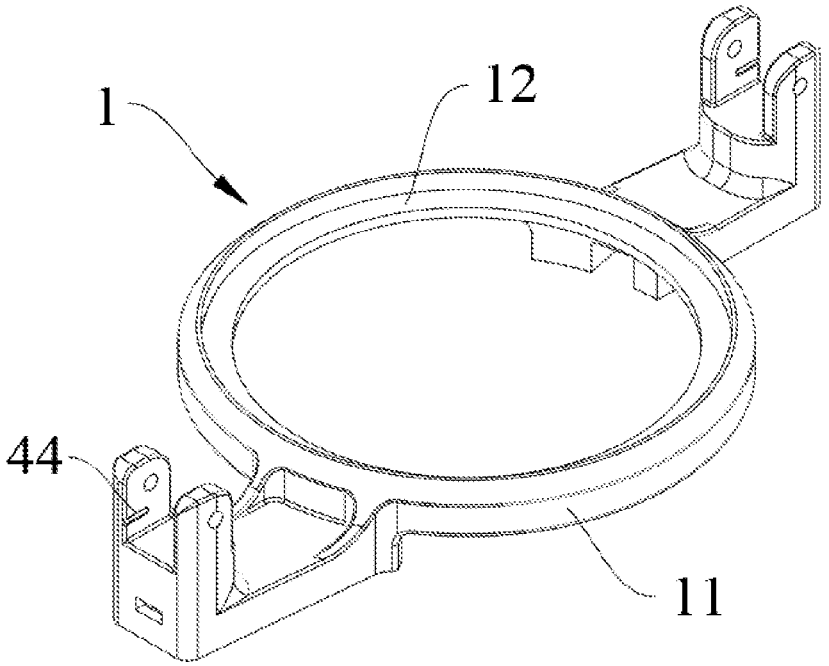
FIG. 4 is a schematic three-dimensional diagram of a first ring assembly of a multifunctional training handle according to an embodiment from another angle.
Figure 5:
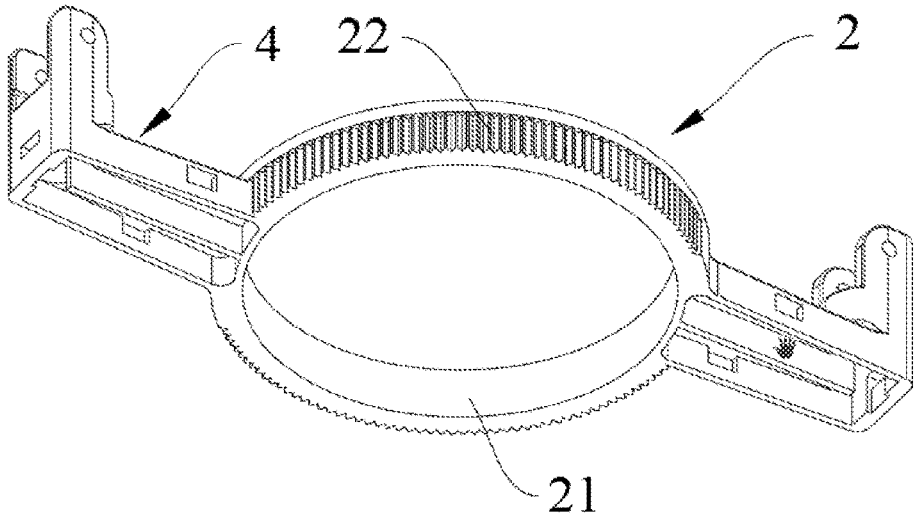
FIG. 5 is a schematic three-dimensional diagram of a second ring assembly of a multifunctional training handle according to an embodiment.

Further referring to FIGS. 4 and 6, a convex block 36 is arranged on a side surface that is of the first hinge part 32 and that is close to the second hinge part 43; and the second hinge part 43 is provided with a horizontal groove 44 that cooperates with the convex block 36. When the hanging claw assemblies 3 are folded to the inner sides of the first ring assembly 1 and the second ring assembly 2 through the hinge structures and are in a horizontal state, the convex block 36 slides into the groove 44 to temporarily fix the hanging claw assemblies 3, so that when the top end of the training handle is placed downwards, the hanging claw assemblies 3 does not turn downwards.

Further referring to FIGS. 3, 4, 5, 10 and 14, the first ring assembly 1 comprises a first ring loop 11, and a first inner ring 12 is fixed on an inner wall of the first ring loop 11; the second ring assembly 2 comprises a second ring loop 21; the training handle further comprises a third ring assembly 7; the third ring assembly 7 comprises a third ring loop 71, and a second inner ring 72 is fixed on an inner wall of the third ring loop 71; the third ring loop 71 and the first ring loop 11 are mounted and fixed, an outer side surface of the second ring loop 21 is in clearance fit with the inner wall of the first ring loop 11, a top surface of the second ring loop cooperates with a bottom surface of the first inner ring 12, and a bottom surface of the second ring loop cooperates with a top surface of the second inner ring 72; the four connecting parts 4 are separately and correspondingly fixed on an outer periphery of the first ring loop 11 and an outer periphery of the second ring loop 21; and a space for the connecting part 4 fixed by the second ring loop 21 to pass through and move is reserved between the first ring loop 11 and the third ring loop 71. Specifically, a first fixing hole 47 is formed in a position that is of the connecting part 4 of the first ring loop 11 and that is close to the first ring loop 11, and a second fixing hole 75 is formed in a position that is of the third ring loop 71 and that corresponds to the first fixing hole 47; the first fixing hole 47 and the third fixing hole 75 are configured to fixedly connect the third ring loop 71 and the first ring loop 11 through a fastener, the first fixing hole 47 may be a threaded hole, the third fixing hole 75 may be a countersunk through hole, and the fastener may be a half-threaded bolt, and of course, the first ring loop and the third ring loop may also be fixed in other manners.

Figure 7:
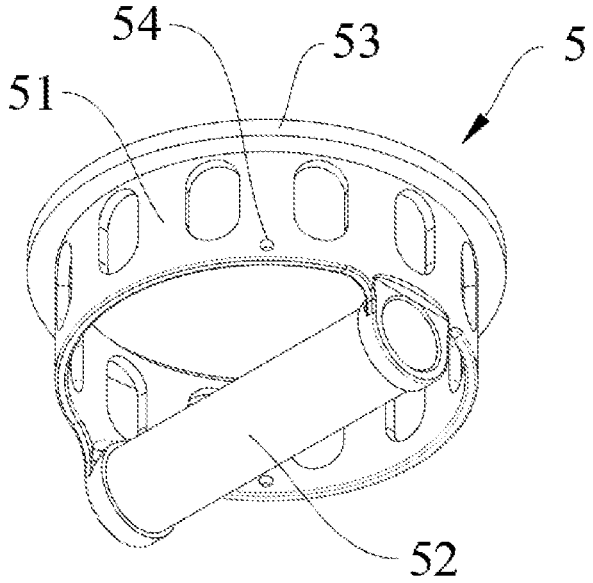
FIG. 7 is a schematic three-dimensional diagram of a handle assembly of a multifunctional training handle according to an embodiment.
Figure 11:
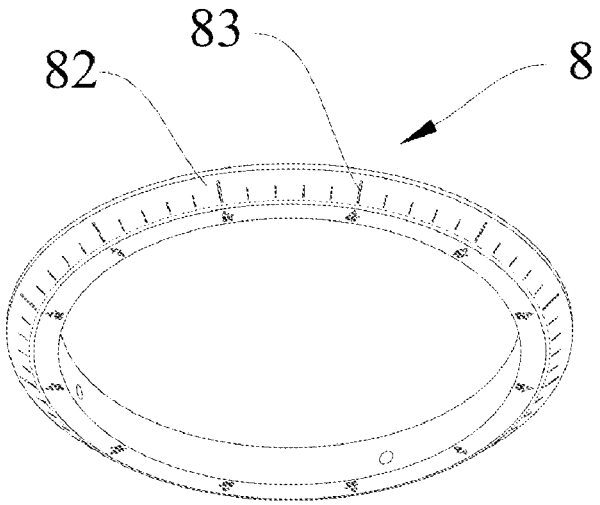
FIG. 11 is a schematic three-dimensional diagram of a fourth ring assembly of a multifunctional training handle according to an embodiment.
Figure 14:
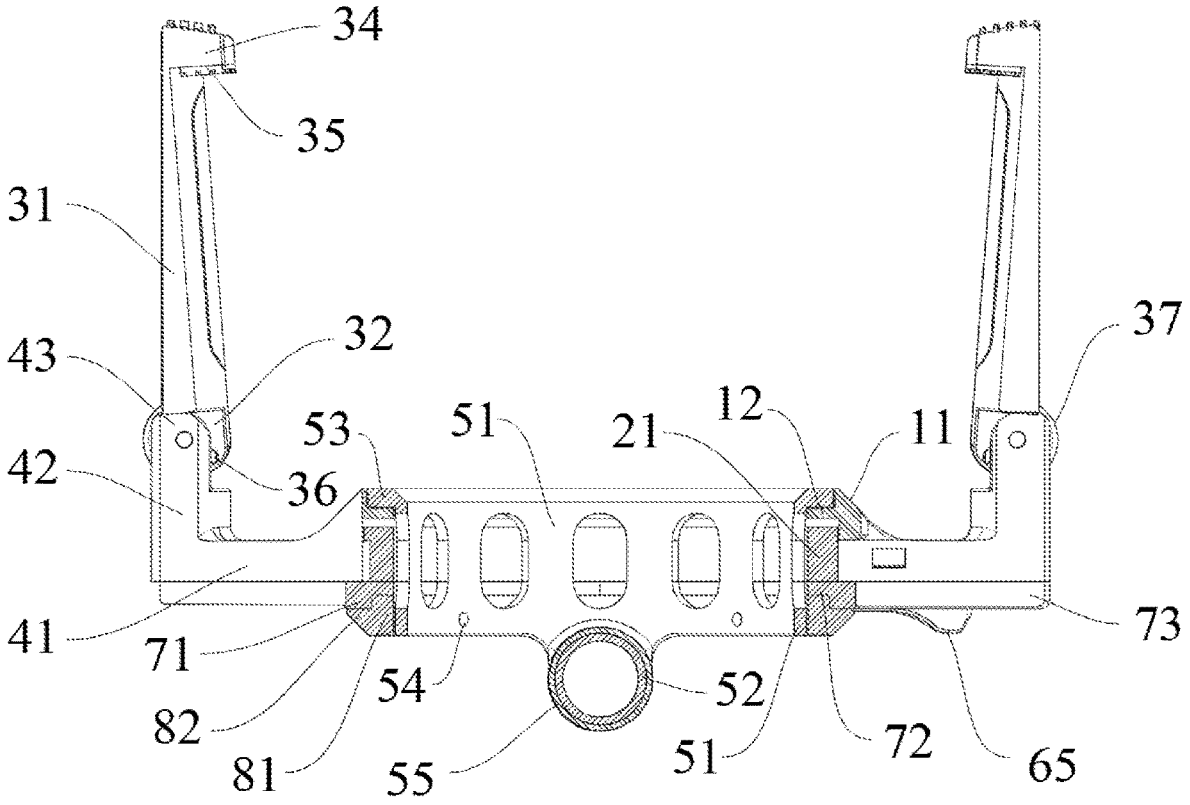
FIG. 14 is a schematic sectional diagram of A-A in FIG. 13.

Further referring to FIGS. 7, 11 and 14, the handle assembly 5 comprises a fourth ring loop 51 and a handle 52 fixed on a bottom side of the fourth ring loop 51; a first outer convex ring 53 is arranged on a top side of the fourth ring loop 51; the training handle further comprises a fourth ring assembly 8, the fourth ring assembly 8 comprises a fifth ring loop 81; a second outer convex ring 82 is arranged at a bottom side of the fifth ring loop 81; an outer side surface of the fifth ring loop 81 is in clearance fit with the inner wall of the third ring loop, a top surface of the fifth ring loop cooperates with a bottom surface of the second inner ring 72, and a top surface of the second outer convex ring 82 cooperates with a bottom surface of the third ring loop 71; the fourth ring loop 51 passes through inner sides of the first inner ring 12, the second ring loop 21, the second inner ring 72 and the fourth ring loop 51, and a bottom surface of the first outer convex ring 53 cooperates with a top surface of the first inner ring 12; and the fifth ring loop 81 is fixedly connected to the fourth ring loop 51.

Figure 12:
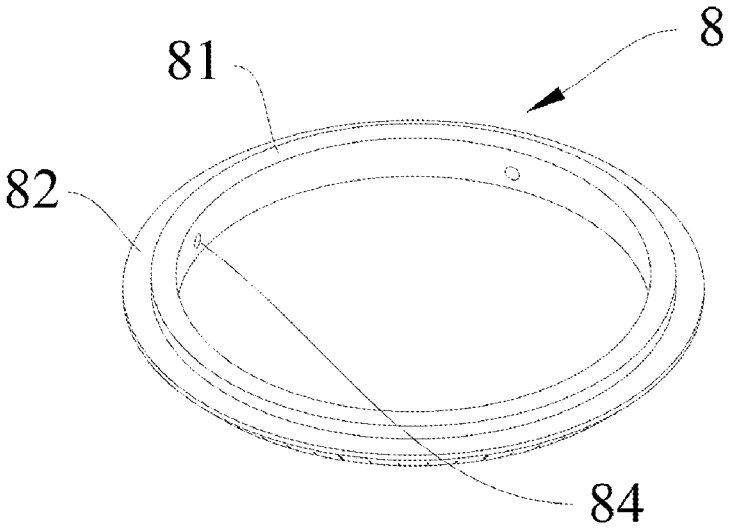
FIG. 12 is a schematic three-dimensional diagram of a fourth ring assembly of a multifunctional training handle according to an embodiment from another angle.
Figure 13:
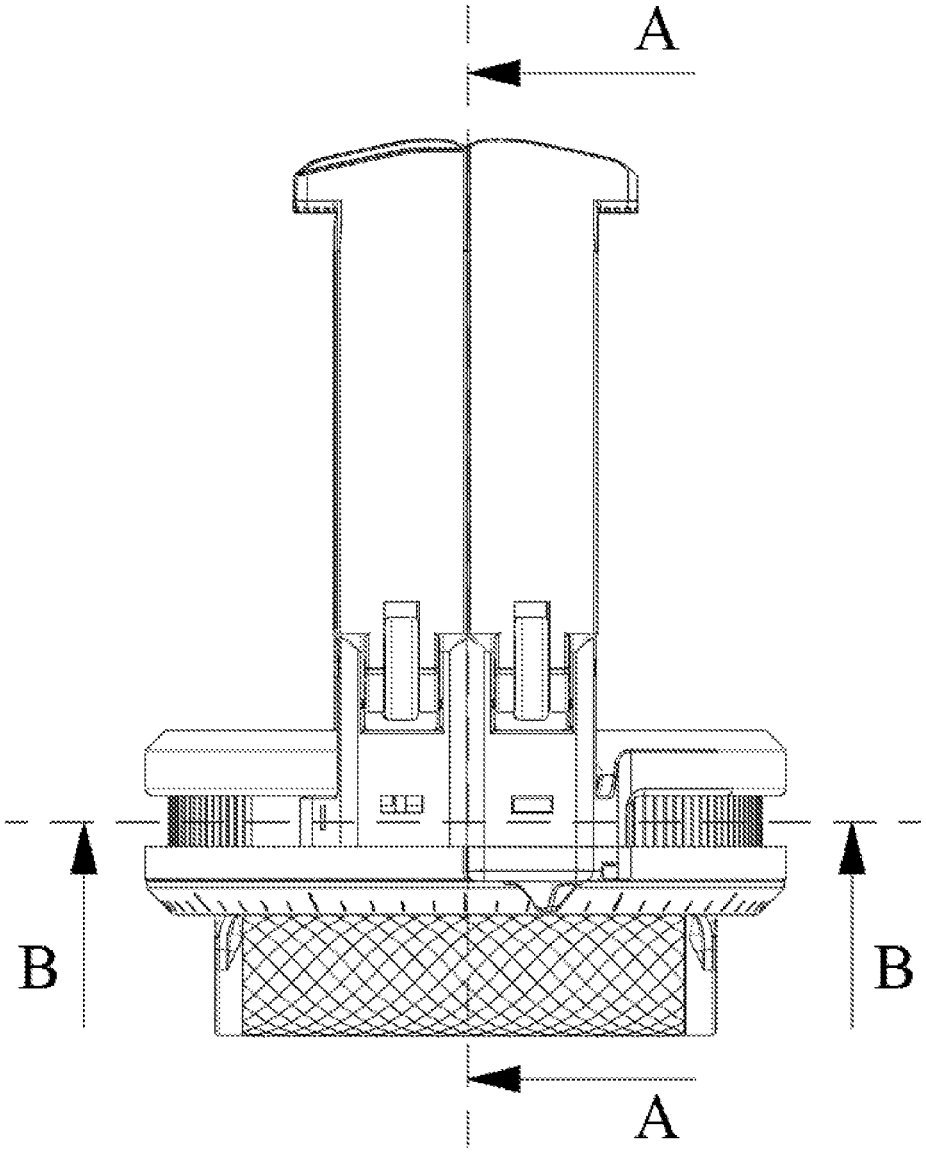
FIG. 13 is a schematic right view of a multifunctional training handle according to an embodiment.

Further referring to FIGS. 7 and 12, a third fixing hole 54 is formed in a position that is of an inner wall of the fourth ring loop 51 and that corresponds to the fifth ring loop 81, a fourth fixing hole 84 is formed in a position that is of the fifth ring loop 81 and that corresponds to the third fixing hole 54, and the third fixing hole 54 and the fourth fixing hole 84 are configured to fixedly connect the fourth ring loop 51 and the fifth ring loop 84 by a fastener.

Further referring to FIG. 14, the handle 52 is in a shape of a hollow circular tube. The handle can be passed through by ropes, rods and the like, so as to be used as a hanger for other equipment. In addition, an anti-slip sleeve 55 or an anti-slip layer is provided on an outer side of the handle 52.

Figure 18:
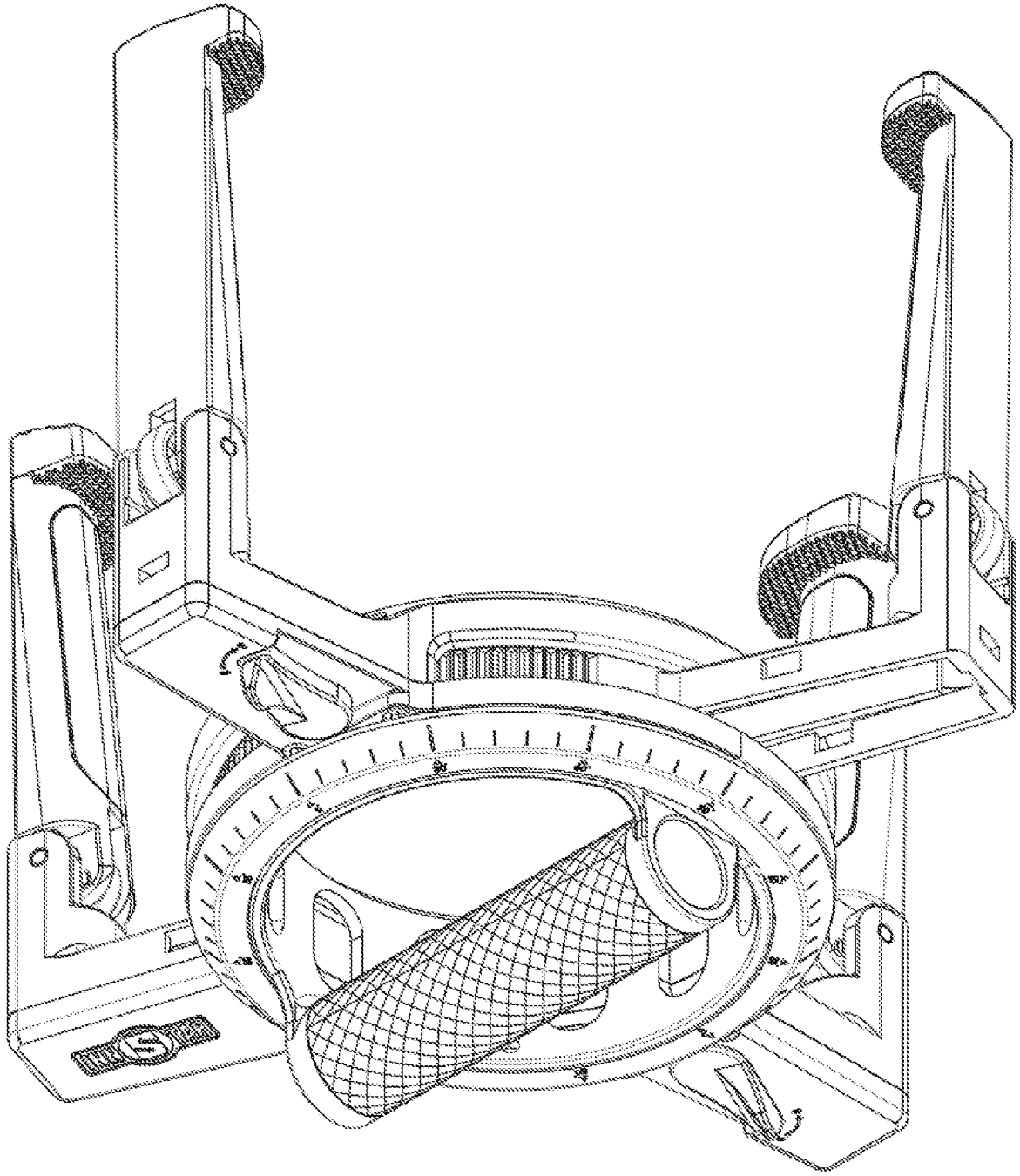
FIG. 18 is a schematic three-dimensional diagram of a state in which two hanging claw assemblies on the same side of a multifunctional training handle according to an embodiment are far away from each other.

Further referring to FIGS. 11 and 18, a bottom end face of the fourth ring assembly 8 is further provided with a scale 83 for displaying a rotation angle of the handle; according to the multifunctional training handle of this embodiment, the handle assembly 5 also has a degree of freedom of coaxial rotation relative to the first ring assembly 1, that is, a gripping angle of the handle can be controlled. When the training handle is clamped on the door frame, the gripping angle of the hand of the user can be controlled by rotating the handle; and when the user performs the pull-up action, different areas of the back muscle of the user are stimulated to different degrees under different gripping angles, so that the back muscle is more fully contracted, and the training effect is effectively improved.

According to the multifunctional training handle of this embodiment, a lock assembly 6 is further arranged between the first ring assembly 1 and the second ring assembly 2, and the lock assembly is configured to enable the first ring assembly 1 and the second ring assembly 2 to be in a locking state or an unlocking state. The locking state means that the first ring assembly 1 and the second ring assembly 2 are relatively fixed and cannot rotate; and the unlocking state means that the first ring assembly 1 and the second ring assembly 2 can be rotated relative to each other.

Figure 8:
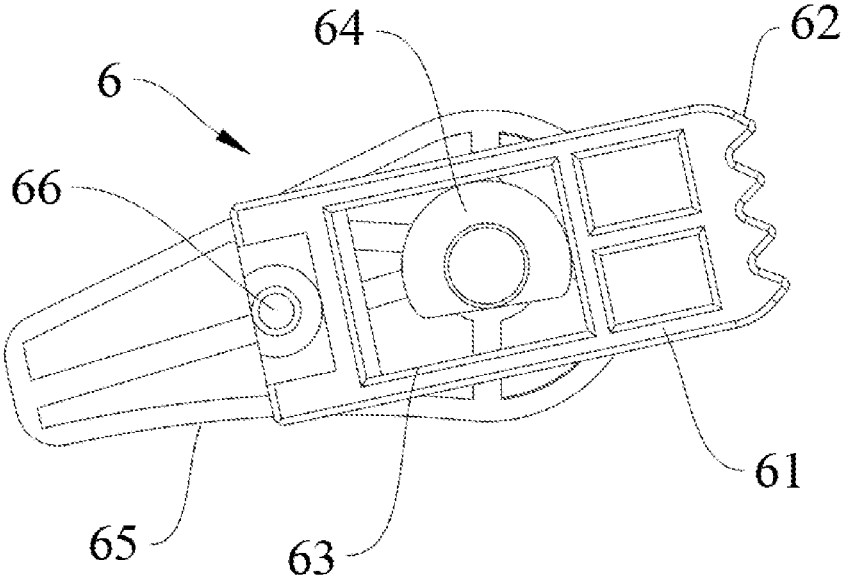
FIG. 8 is a schematic top view of a multifunctional training handle according to an embodiment with a lock assembly locked.
Figure 9:
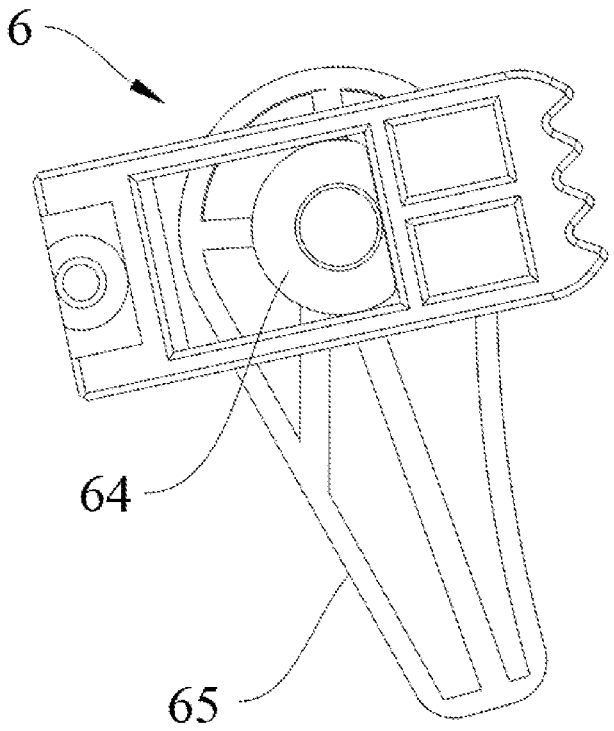
FIG. 9 is a schematic top view of a multifunctional training handle according to an embodiment with a lock assembly unlocked.
Figure 15:
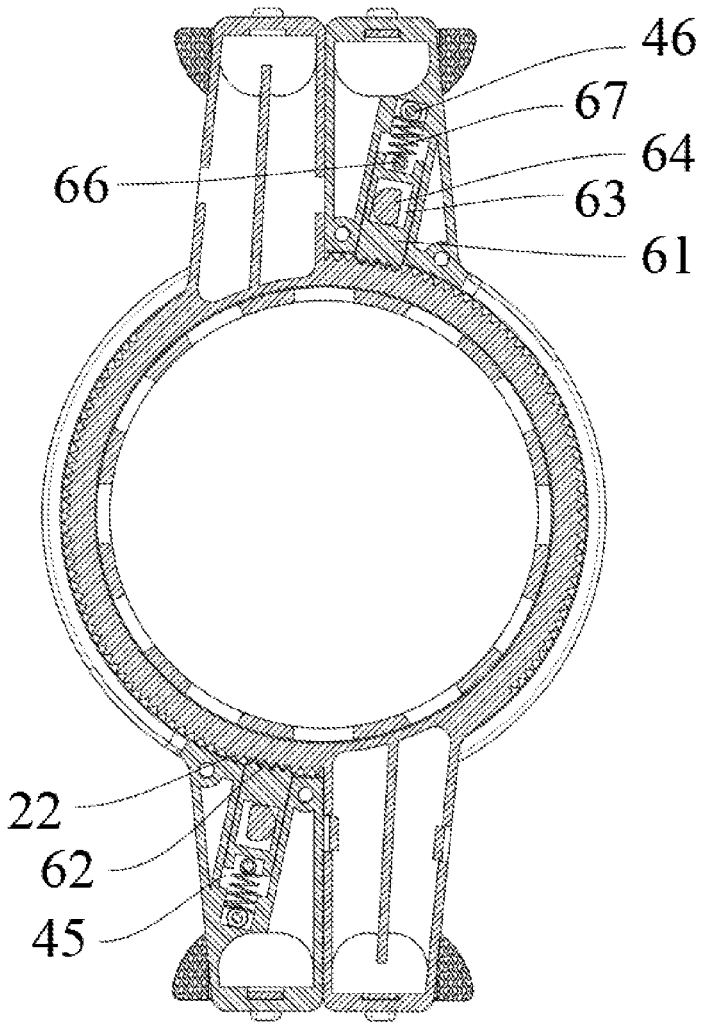
FIG. 15 is a schematic sectional diagram of B-B in FIG. 13.

Specifically, further referring to FIGS. 8, 9 and 15, a first tooth part 22 is arranged on the outer periphery of the second ring loop 21; the connecting part 4 of the first ring loop 11 is provided with a slide rail 45 that is opened towards an inner side; the lock assembly 6 comprises a lock block 61 slidably arranged in the slide rail 45 and a shifting mechanism 64 configured to control the lock block 61 to move along the slide rail 45; and an end part of the lock block 61 is also provided with a second tooth part 62, so that the second tooth part 62 is engaged with or separated from the first tooth part 22 when the lock block 61 moves along the slide rail 45 under the control of the shifting mechanism 64, and further the first ring loop 11 and the second ring loop 21 are in a locking state or an unlocking state; a shifting groove 63 is arranged in the lock block 61; the shifting mechanism 64 comprises a rotating shaft and a reducing shifting block fixed to the rotating shaft, the reducing shifting block is arranged in the shifting groove 63, and the reducing shifting block has a small-diameter end and a large-diameter end; the rotating shaft is configured to drive the reducing shifting block to enable a position in contact with the shifting groove 63 to be switched from the small-diameter end to the large-diameter end, and then the lock block 61 is shifted to move towards the first tooth part 22 along the slide rail 45; a reset assembly 67 is further arranged between one end that is of the lock block 61 and that is far away from the second tooth part 62 and one end that is of the slide rail 45 and that is far away from the inner side opening; the reset assembly is configured to pull the lock block 61 to move away from the first tooth part 22 along the slide rail 45 when the reducing shifting block is switched from the large-diameter end to the small-diameter end; the reducing shifting block contacts one end that is of the shifting groove 63 and that is close to the second tooth part 62; a first fixed rod 66 is formed at one end that is of the lock block 61 and that is far away from the second tooth part 62, and a second fixed rod 46 is formed at one end of that is the slide rail 45 and that is far away from the inner side opening; and a spring providing a pulling force is provided between the first fixed rod 66 and the second fixed rod 46 as a reset assembly 67.

Figure 2:
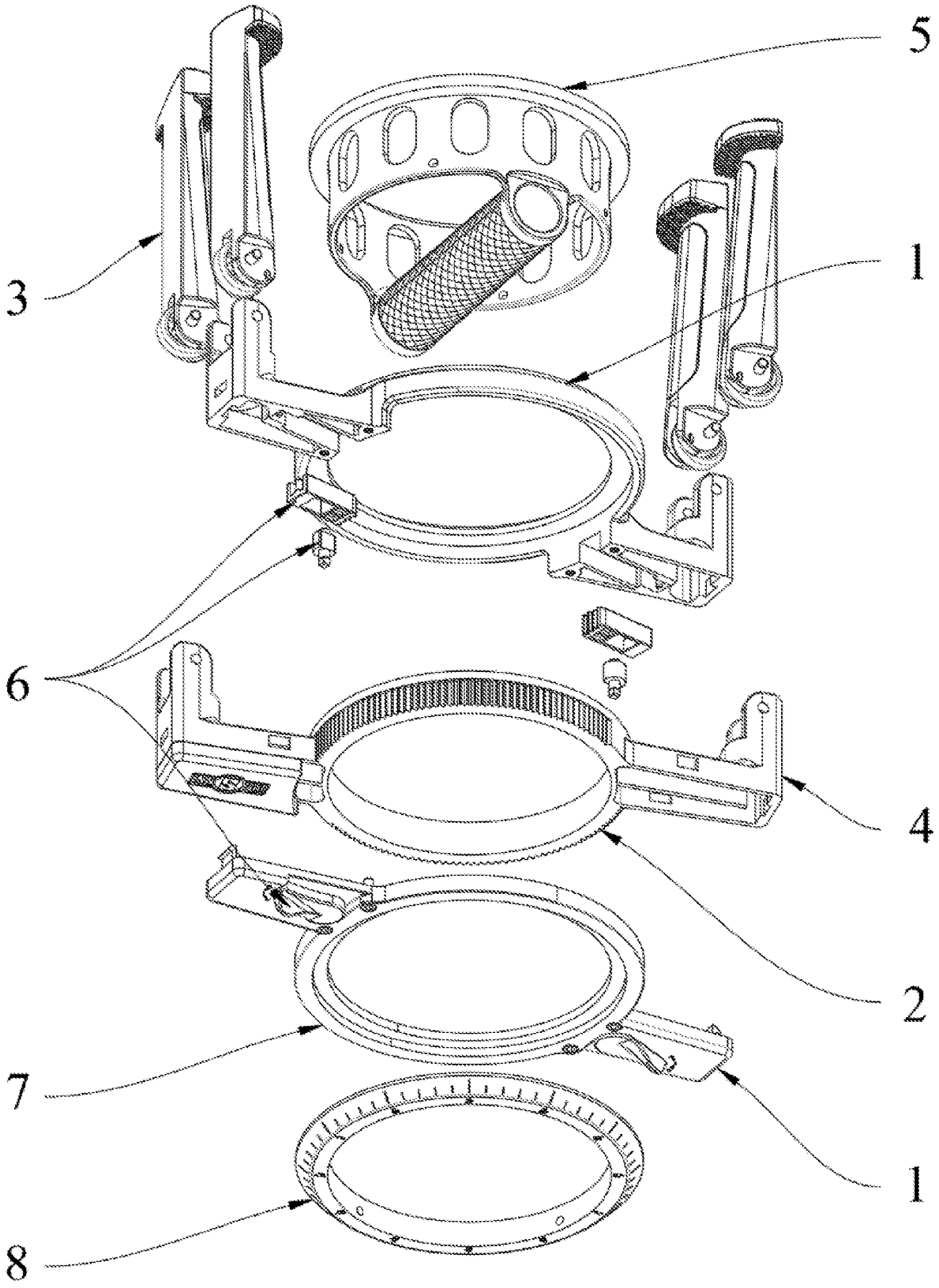
FIG. 2 is a schematic exploded view of a multifunctional training handle according to an embodiment.
Figure 10:
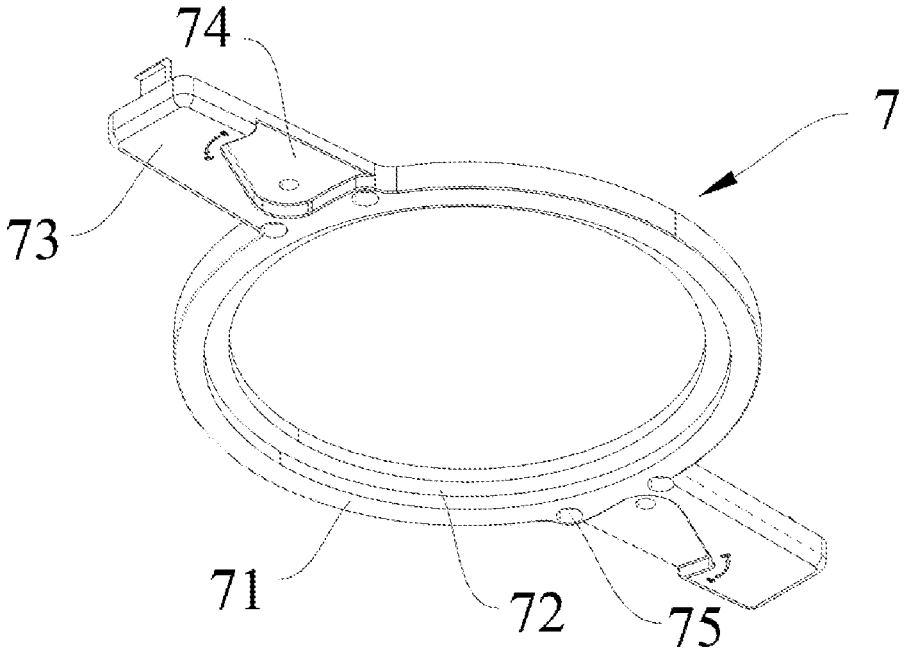
FIG. 10 is a schematic three-dimensional diagram of a third ring assembly of a multifunctional training handle according to an embodiment.

Further referring to FIGS. 2 and 10, the lock assembly 6 further comprises a shifting handle 65; a cover 73 is further arranged on an outer periphery of the third ring loop 71, and the cover 73 is fixedly mounted at a bottom end of the connecting part 4 fixed to the first ring loop 11; and the rotating shaft of the shifting mechanism 64 passes through the cover 73 downwards and then is fixedly connected to the shifting handle 65. A bottom surface of the cover 73 is also provided with a handle groove 74 that accommodates the shifting handle 65 and a motion range of the shifting handle.

The multifunctional training handle of this embodiment can be used alone, or can be used by two or more in combination:

A. Used alone

A1. the multifunctional training handle is hung on a door frame for single-arm pull-up training;

A2. the multifunctional training handle is used as an abdominal wheel, the hands are adjusted to be vertical to the advancing direction of the wheel, and then two hands grip the same handle for abdominal muscle training;

A3. the multifunctional training handle is used as push-up equipment for single-arm push-up training;

B. Used by two in combination

B1. the multifunctional training handle is hung on a door frame, a distance between the two training handles is adjusted and locked, and then conventional pull-up training is performed;

B2. the multifunctional training handle is hung on a door frame and used as a hanger for other equipment, for example, a rod passes through the handles of two training handles to form a horizontal bar structure; or a rope passes through the handles for related training; when the multifunctional training handle is used as the hanger, two or more training handles can be used for assembly;

B3. the multifunctional training handle is used as an abdominal wheel, and two hands grip the training handles respectively for abdominal muscle training, so that more actions can be performed; and B4. the multifunctional training handle is used as push-up equipment for conventional push-up training.

The above use methods are only some examples. Based on the multifunctional design of the training handle of this embodiment, more training actions can be designed to improve the fun of training.

According to the multifunctional training handle of this embodiment, a structure of two pairs of four hanging claws is used, so that the handle may be hung on a door frame for use; the handle is firmly fixed, convenient to disassemble and assemble, saves space, has a small volume and is convenient to carry; by means of the two ring structures that can rotate relative to one another, a distance between hanging claws may be rapidly adjusted so as to adapt to door frames of different thicknesses; after simple deformation, the handle can serve as push-up equipment and abdominal wheel for use; the design of the hollow circular tube of handle allows the entire training handle to be used as a hanger for other equipment; therefore, the handle has abundant functions and high practicability.

The above embodiments should not limit the present invention in any way, and all technical solutions obtained by using equivalent substitution or equivalent conversion shall fall within the protection scope of the present invention.

The invention claimed is:

1. A multifunctional training handle, comprising: a first ring assembly, a second ring assembly, four hanging claw assemblies and a handle assembly; wherein the hanging claw assemblies each comprise a claw arm and a claw part that is fixed to a top end of the claw arm, and claw parts of the four hanging claw assemblies are configured to be hung in pairs on top edges of two sides of a door frame in a thickness direction;

one pair of hanging claw assemblies fixed on one side of the door frame in the thickness direction and one pair of hanging claw assemblies fixed on the other side of the door frame in the thickness direction form a group and are mounted on the first ring assembly through connecting parts respectively; the other pair of hanging claw assemblies form another group and are mounted on the second ring assembly through connecting parts respectively;

the first ring assembly and the second ring assembly are assembled, and the second ring assembly has a degree of freedom of coaxial rotation relative to the first ring assembly; and the handle assembly is mounted with the first ring assembly and/or the second ring assembly.

2. The multifunctional training handle according to claim 1, wherein a bottom end of the claw arm is connected to the connecting part through a hinge structure.

3. The multifunctional training handle according to claim 2, wherein the hinge structure comprises a first hinge part arranged at the bottom end of the claw arm, a second hinge part arranged on the connecting part and a pin rod; the pin rod passes through the first hinge part and the second hinge part; and a wheel is further sleeved on the pin rod.

4. The multifunctional training handle according to claim 1, wherein the first ring assembly comprises a first ring loop, and a first inner ring is fixed on an inner wall of the first ring loop; the second ring assembly comprises a second ring loop; the training handle further comprises a third ring assembly; the third ring assembly comprises a third ring loop, and a second inner ring is fixed on an inner wall of the third ring loop; the third ring loop and the first ring loop are mounted and fixed, an outer side surface of the second ring loop is in clearance fit with the inner wall of the first ring loop, a top surface of the second ring loop cooperates with a bottom surface of the first inner ring, and a bottom surface of the second ring loop cooperates with a top surface of the second inner ring; the four connecting parts are separately and correspondingly fixed on an outer periphery of the first ring loop and an outer periphery of the second ring loop; and a space for the connecting part fixed by the second ring loop to pass through and move is reserved between the first ring loop and the third ring loop.

5. The multifunctional training handle according to claim 4, wherein the handle assembly comprises a fourth ring loop and a handle fixed on a bottom side of the fourth ring loop; a first outer convex ring is arranged on a top side of the fourth ring loop; the training handle further comprises a fourth ring assembly, the fourth ring assembly comprises a fifth ring loop; a second outer convex ring is arranged at a bottom side of the fifth ring loop; an outer side surface of the fifth ring loop is in clearance fit with the inner wall of the third ring loop, a top surface of the fifth ring loop cooperates with a bottom surface of the second inner ring, and a top surface of the second outer convex ring cooperates with a bottom surface of the third ring loop; the fourth ring loop passes through inner sides of the first inner ring, the second ring loop, the second inner ring and the fourth ring loop, and a bottom surface of the first outer convex ring cooperates with a top surface of the first inner ring; and the fifth ring loop is fixedly connected to the fourth ring loop.

6. The multifunctional training handle according to claim 5, wherein the handle is in a shape of a hollow circular tube.

7. The multifunctional training handle according to claim 5, wherein a lock assembly is further arranged between the first ring assembly and the second ring assembly, and the lock assembly is configured to enable the first ring assembly and the second ring assembly to be in a locking state or an unlocking state.

8. The multifunctional training handle according to claim 7, wherein a first tooth part is arranged on the outer periphery of the second ring loop; the connecting part of the first ring loop is provided with a slide rail that is opened towards an inner side; the lock assembly comprises a lock block slidably arranged in the slide rail and a shifting mechanism configured to control the lock block to move along the slide rail; and an end part of the lock block is also provided with a second tooth part, so that the second tooth part is engaged with or separated from the first tooth part when the lock block moves along the slide rail under the control of the shifting mechanism, and further the first ring loop and the second ring loop are in a locking state or an unlocking state.

9. The multifunctional training handle according to claim 8, wherein a shifting groove is arranged in the lock block; the shifting mechanism comprises a rotating shaft and a reducing shifting block fixed to the rotating shaft, the reducing shifting block is arranged in the shifting groove, and the reducing shifting block has a small-diameter end and a large-diameter end;

the rotating shaft is configured to drive the reducing shifting block to enable a position in contact with the shifting groove to be switched from the small-diameter end to the large-diameter end, and then the lock block is shifted to move towards the first tooth part along the slide rail; a reset assembly is further arranged between one end that is of the lock block and that is far away from the second tooth part and one end that is of the slide rail and that is far away from the inner side opening; the reset assembly is configured to pull the lock block to move away from the first tooth part along the slide rail when the reducing shifting block is switched from the large-diameter end to the small-diameter end.

10. The multifunctional training handle according to claim 9, wherein the lock assembly further comprises a shifting handle; a cover is further arranged on an outer periphery of the third ring loop and fixedly mounted at a bottom end of the connecting part fixed to the first ring loop; and the rotating shaft of the shifting mechanism passes through the cover downwards and then is fixedly connected to the shifting handle.

* * * * *